United States Patent [19]

Cole

[11] 4,060,704

[45] Nov. 29, 1977

[54] ALARM SWITCH HAVING RESILIENT GRIPPING STRUCTURE FOR SENSING UNAUTHORIZED MOVEMENT OF A DOOR

[75] Inventor: Donald G. Cole, Springfield, Mo.

[73] Assignee: Silent Sentry, Inc., Springfield, Mo.

[21] Appl. No.: 658,240

[22] Filed: Feb. 17, 1976

[51] Int. Cl.[2] ..... H01H 3/16

[52] U.S. Cl. ..... 200/61.62; 200/61.93; 200/161; 200/332

[58] Field of Search ..... 200/52 R, 61.41, 61.62, 200/61.69, 61.71, 61.75, 61.76–61.84, 61.93, 153 T, 161, 329–332

[56] References Cited

U.S. PATENT DOCUMENTS

| | | | |
|---|---|---|---|
| 2,208,721 | 7/1940 | Demosthenes | 200/61.93 |
| 2,305,603 | 12/1942 | Cadman | 200/52 R |
| 2,516,163 | 7/1950 | Vaughan | 200/332 X |
| 3,931,488 | 1/1976 | Beyer | 200/332 X |
| 3,968,337 | 7/1976 | Cole | 200/61.81 |

FOREIGN PATENT DOCUMENTS

| | | | |
|---|---|---|---|
| 22,112 of | 1893 | United Kingdom | 200/61.84 |

*Primary Examiner*—James R. Scott
*Attorney, Agent, or Firm*—Koenig, Senniger, Powers and Leavitt

[57] ABSTRACT

An alarm switch is mounted by means of a support for actuation by relative movement between the support and a member such as a door or window. Switches are carried by the support and an operating arm for the switches extends from the support and is adapted to be pulled a limited distance relative to the support for actuating the switches to complete an alarm circuit. Interengageable gripping members on the arm and the member pull the arm the limited distance relative to the support to actuate the switches when there is relative movement between the member and the support, and automatically disengage to free the member from the arm when the relative movement is greater than the limited distance. The gripping members are selectively disengageable to permit relative movement between the support and the member without actuating the alarm switch.

4 Claims, 7 Drawing Figures

ALARM SWITCH HAVING RESILIENT GRIPPING STRUCTURE FOR SENSING UNAUTHORIZED MOVEMENT OF A DOOR

BACKGROUND OF THE INVENTION

This invention relates to an alarm switch, and particularly to a burgular alarm switch with mounting means for actuation by relative movement between the mounting means and a member such as a door or window.

SUMMARY OF THE INVENTION

Among the several objects of this invention may be noted the provision of a simple, inexpensive and efficient burglar alarm switch for actuation by relative movement between the mounting means for the alarm switch and a member such as a door or window; and the provision of such a switch which is readily adapted to be mounted and set to detect relative movement between the alarm switch mounting means and a member, and quickly and easily deactivated for moving the member relative to the mounting means without signalling an alarm.

Briefly, the alarm switch of this invention has mounting means comprising a support and is actuated by relative movement between the support and a member, especially a door or window. Switches are carried by the support and an operating arm for the switches extends from the support and is adapted to be pulled a limited distance relative thereto for actuating the switches to complete an alarm circuit. Interengageable gripping members on the arm and the member pull the arm said limited distance relative to the support to actuate the switches when there is relative movement between the member and the support, and automatically disengage to free the member from the arm when the relative movement is greater than said limited distance. The gripping members are initially disengageable to permit relative movement between the member and mounting means without actuating the alarm switch. Other objects and features will be in part apparent and in part pointed out hereinafter.

Brief Description of the Drawings

Corresponding reference characters indicate corresponding parts throughout the several views of the drawings.

Description of the Preferred Embodiments

Figure 1:
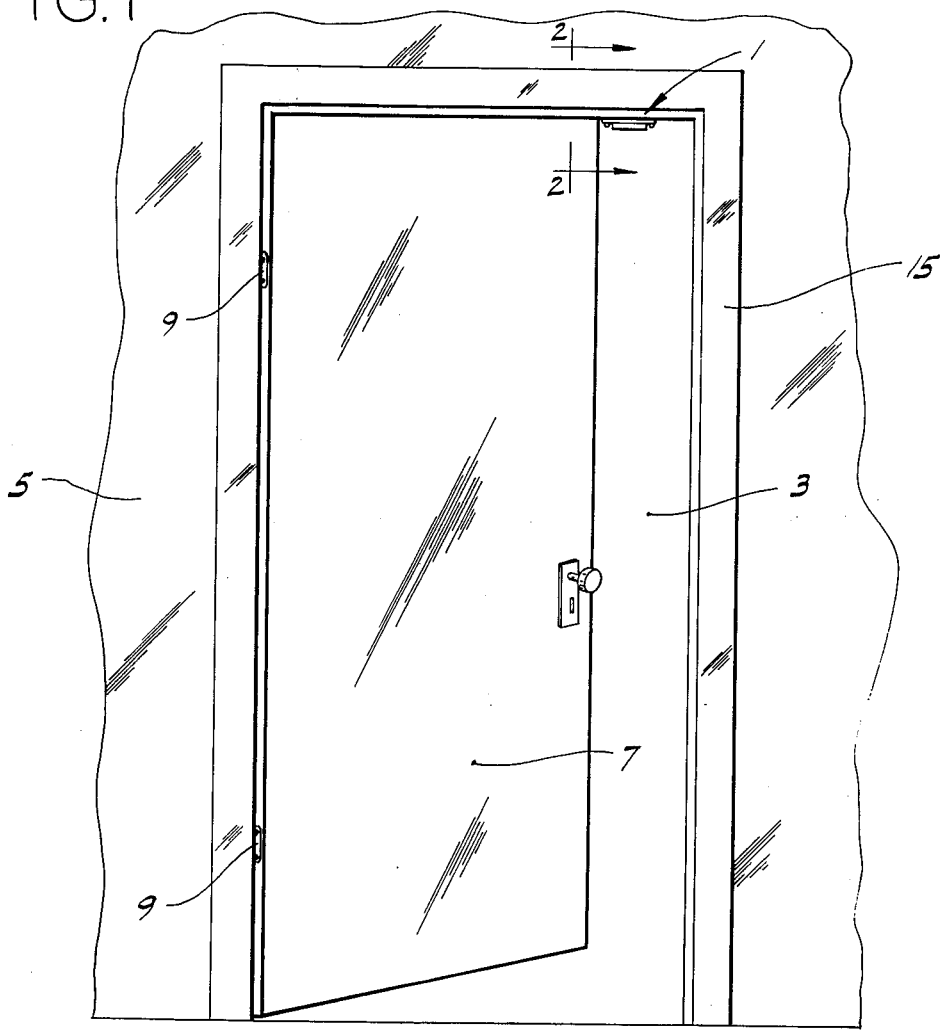
FIG. 1 is a view showing a switch of this invention mounted on the trim of a door frame at the top of the door.
Figure 2:
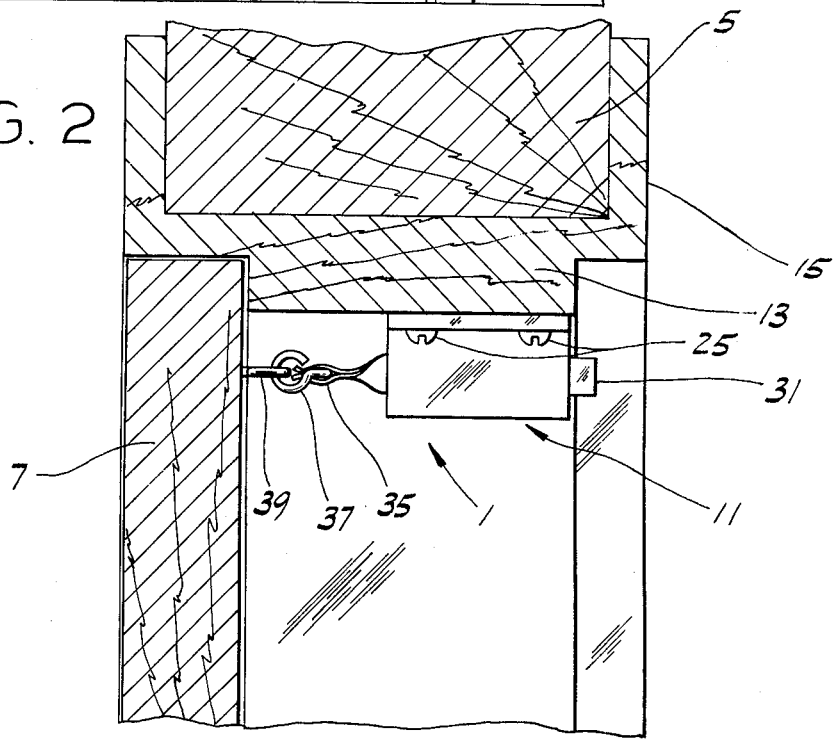
FIG. 2 is an enlarged vertical section taken along line 2—2 in FIG. 1 showing the door closed and the alarm switch set for actuation by the opening of the door.

Referring first to FIG. 1 of the drawings, there is indicated at 1 an alarm switch of this invention mounted in position above a door opening 3 in a wall 5. At 7 is indicated a door in the door opening 3, hinged as indicated at 9 with the door swinging open away from the viewer. As shown in FIG. 2, the switch 1 has mounting means comprising a support, generally designated 11, for mounting switch 1 on the trim 13 of a door frame 15 at the top of the door, but it is to be understood that the support 11 may be similarly mounted on either side of door 7. Switch 1 may also be utilized in conjunction with double doors with support 11 mounted between the two doors and activated by opening the outside door.

Figure 6:
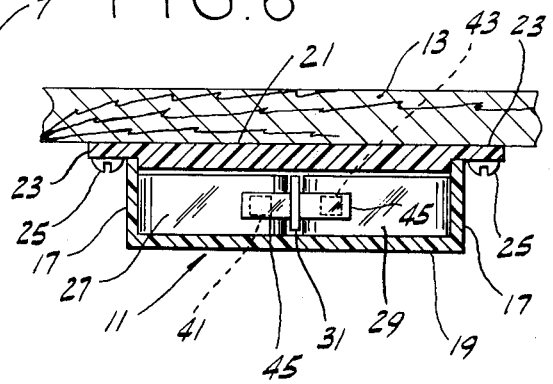
FIG. 6 is a section taken on line 6—6 of FIG. 3 showing the switches disposed in a side-by-side relationship with the operating arm therebetween.

Referring now to FIG. 6, support 11 is comprised of any suitable material (e.g., plastic) and is generally rectangular in form having sides 17, a bottom 19 and a top 21. Flanges designated 23 extend outwardly from support top 21 and have openings 24 therein to receive fasteners 25 (such as conventional wood screws) for securing support 11 to trim 13 of door frame 15. It may be desirable to make support top 21 removable from support sides 17 thereby providing access to the interior of support 11 but it is to be understood that such an arrangement is not necessary for the proper functioning of this invention.

Housed within support 11 is a pair of switches 27 and 29 constituting switching means. Although two switches are shown, it is to be understood that a single switch or more than two switches could be used without departing from the scope of this invention. An operating arm 31 for engaging switches 27 and 29 is slidable between the switches in slots each designated 33 in support sides 17. Arm 31 extends from support 11 in the direction toward the door and is movable forward in slots 33 a limited distance in that direction for simultaneously activating switches 27 and 29 to complete an alarm circuit thereby triggering an alarm.

There are interengageable gripping members comprising a spring clip 35 on the end of operating arm 31 away from the support 11 and a hook 37 swivelly attached to a screw eye 39 adapted to be threaded into door 7. Spring clip 35 and hook 37 are interengageable for having the door 7 pull the arm 31 forward to actuate switches 27 and 29 when the door swings open a limited amount and are automatically disengageable to free the door from the arm when the door swings farther open. It is to be understood that the spring clip 35 may be fastened to the door and hook 37 may be on the end of operating arm 31.

FIGS. 3–6 show switches 27 and 29 to be mounted side-by-side in the support 11 with a space therebetween for operating arm 31. Switches 27 and 29 each have an operating member (e.g., a pushbutton) 41 and 43, respectively, adapted to be pushed in successively to first close and then open the switches. The two switches are mounted in support 11 in any suitable manner (e.g., machine screws securing switches 27 and 29 to support bottom 19) with operating members 41 and 43 on the side of the switch away from the door. Arm 31 is slidable forward and rearward and has a crossbar 45 thereon constituting means for simultaneously engaging operating member 41 of switch 27 on one side of arm 31 and operating member 43 of switch 29 on the other side of arm 31 as door 7 is opened and the arm is pulled forward.

Figure 3:
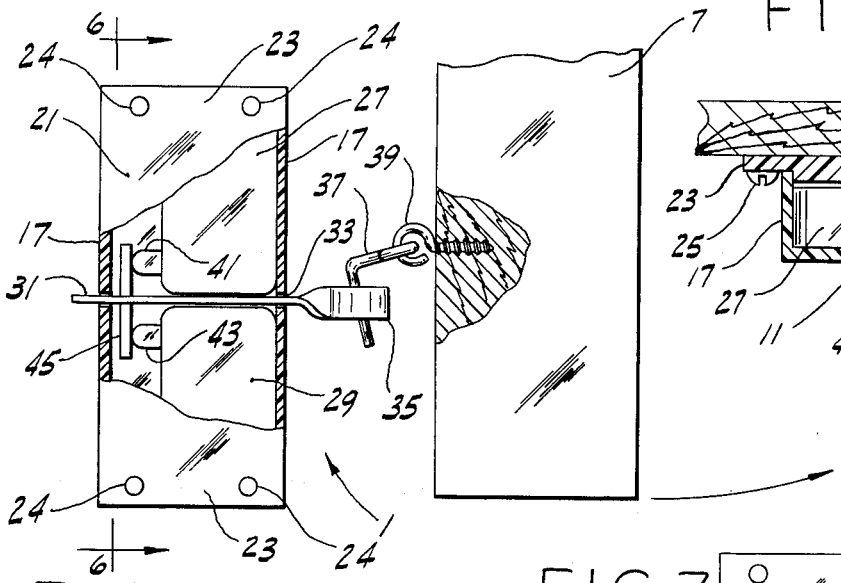
FIG. 3 is a top plan view of an alarm switch with the top of the mounting means broken away showing the alarm switch set for actuation by a door.

In operation, the support 11 is mounted on door frame 15 in such a position that the operating arm 33 extends from the support in the direction toward the door with the screw eye 39 threaded into the door generally opposite the arm as illustrated in FIG. 3. Hook 37 is swivelly attached to screw eye 39 and is interengaged with spring clip 35 on the forward end of operating arm 31 for actuation of the alarm switch by the opening of the door.

Figure 4:
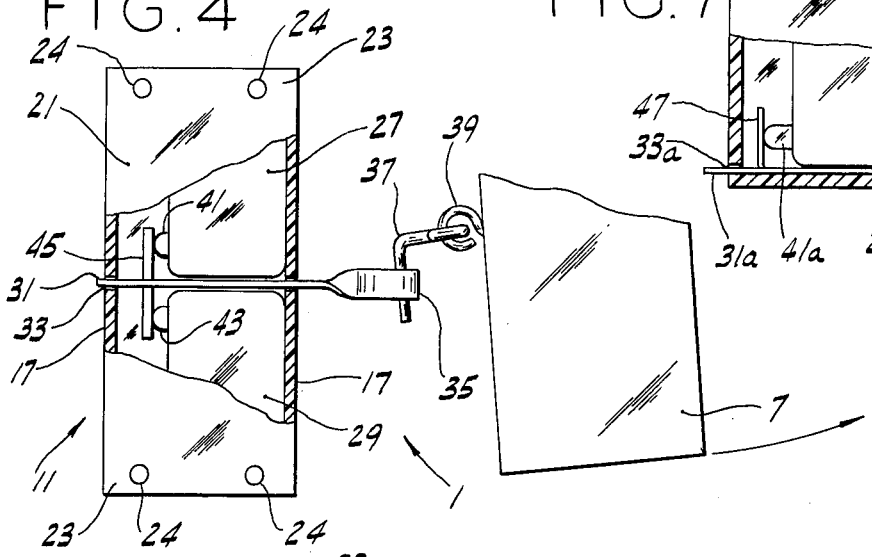
FIG. 4 is another top plan view similar to FIG. 3 showing the actuation of the alarm switch after the door has been swung open a limited amount.

Now referring to FIG. 4, it can be seen that operating arm 31 is pulled forward when the door is opened causing crossbar 45 to engage with operating members (e.g., pushbuttons) 41 and 43. The operating members are simultaneously pushed forward by the crossbar and switches 27 and 29 are closed to complete alarm circuits thereby signalling an alarm. As the door is farther opened (FIG. 5), hook 37 automatically disengages from spring clip 35 to allow the door to be completely opened without harming the alarm switch. After disengagement of arm 31 and door 7, operating members 41 and 43 automatically return to a retracted position with switches 27 and 29 remaining closed and the alarm continuing to signal. The alarm signal may be stopped by manually pulling arm 31 forward causing crossbar 45 to push operating members 41 and 43 forward to open the switches. Upon release of the arm, the operating members automatically return to a retracted position and the entire process can be repeated.

The alarm switch of this invention is also adapted to be selectively deactivated in a quick and easy manner such that the opening of the door will not actuate the alarm switch and trigger an alarm. Spring clip 35 and hook 37 need only be disengaged thereby preventing door 7 from pulling operating arm 31 forward to close switches 27 and 29.

Figure 7:
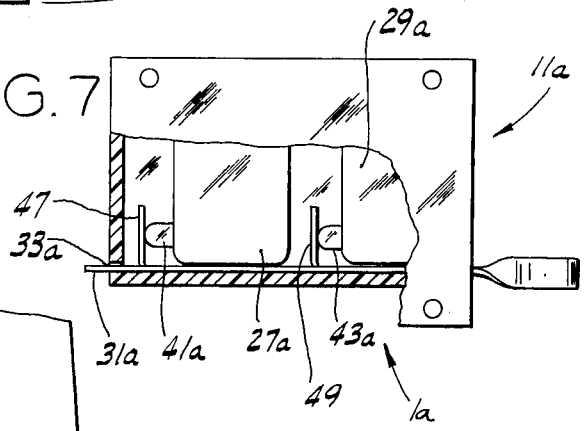
FIG. 7 is a partial plan view of an alternative arrangement wherein the switches are spaced in a forward-to-rearward direction with the arm extending alongside both switches.
Figure 5:
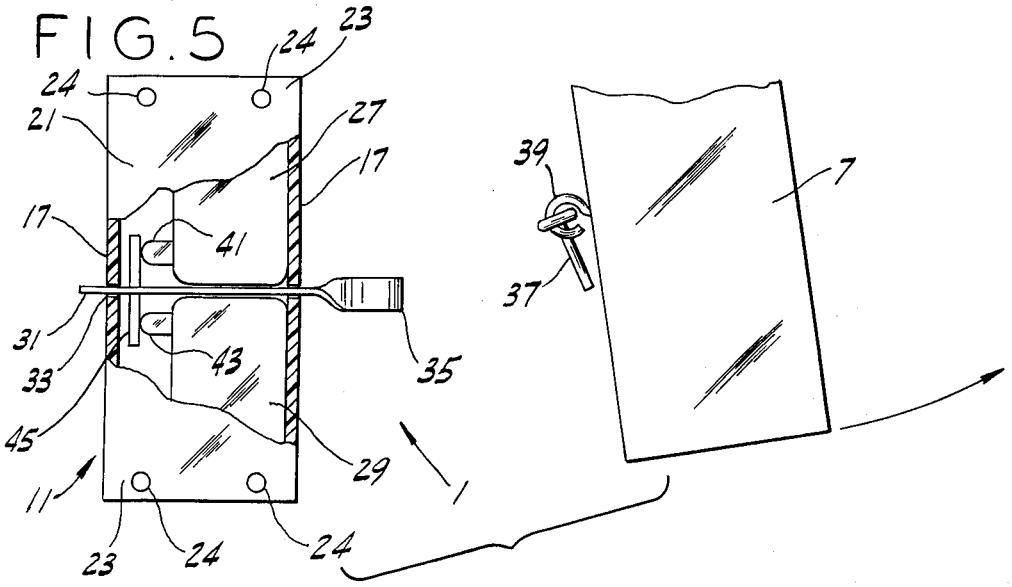
FIG. 5 is a view similar to FIGS. 3 and 4 but depicting the interengageable gripping members disengaged as the door is farther opened.

Alternatively, FIG. 7 shows an alarm switch 1*a* similar to that previously described except that the switches 27*a* and 29*a* are mounted in support 11*a* spaced in a forward-to-rearward direction. Arm 31*a* extends alongside both switches and has lateral fingers 47 and 49 for engaging the operating members 41*a* and 43*a* respectively, as the door is pulled away from the support.

Although the alarm switch of this invention has been described above as being used in conjunction with a door, it is to be understood that it may be similarly utilized for detecting the movement of any object relative to support 11 or 11*a*.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An alarm switch mounted by means of a support for actuation by relative movement between the support and a member such as a door or window comprising:

switching means carried by the support;

an operating arm for the switching means extending from the support and carried thereby, said arm being adapted to be pulled a limited distance relative to the support for actuating the switching means to complete an alarm circuit; and interengageable gripping members on the arm and said member for pulling the arm said limited distance relative to the support to actuate the switching means when there is relative movement between the member and the support, and said gripping members automatically disengaging to free the member from the arm when the relative movement between the member and the support is greater than said limited distance, said gripping members being selectively disengageable to permit relative movement between the support and said member without actuating the alarm switch, said switching means comprising at least one switch having an operating member adapted to be pushed in to close the switch and to be pushed in again to open the switch, said arm being engageable with said operating member to push it in to close the switch when said member moves relative to the support, the gripping members then disengaging and the switch remaining closed.

2. An alarm switch as set forth in claim 1 wherein said switching means comprises a pair of switches each having an operating member adapted to be pushed in to close the switch and to be pushed in again to open the switch, said arm being slidable relative to the switches and having means thereon engageable with the operating members to simultaneously push them in to close the switches when said member moves relative to the support, the gripping members then disengaging and the switches remaining closed.

3. An alarm switch as set forth in claim 2 wherein the switches are mounted on the support with a space therebetween, the arm extending between said switches and the means on the arm comprising a crossbar engageable on one side of the arm with the operating member of one switch and on the other side of the arm with the operating member of the other switch.

4. An alarm switch as set forth in claim 2 wherein the switches are mounted on the support means with the arm extending alongside but not between both switches, said arm having lateral fingers engageable with the operating members of the switches.

* * * * *